United States Patent [19]

Hughes

[11] 4,327,829

[45] May 4, 1982

[54] DISPLAY CARTON AND BLANK THEREFOR

[75] Inventor: Robert G. Hughes, Rexdale, Canada

[73] Assignee: The Continental Group of Canada Ltd., Toronto, Canada

[21] Appl. No.: 154,429

[22] Filed: May 29, 1980

[51] Int. Cl.[3] ..... B65D 5/46

[52] U.S. Cl. ..... 206/193; 229/52 BC; 206/199

[58] Field of Search ..... 206/199, 193, 491, 45.31; 229/28 R, 28 BC, 52 BC

[56] References Cited

U.S. PATENT DOCUMENTS

| | | | |
|---|---|---|---|
| 2,160,550 | 5/1939 | Lupton | 229/52 BC X |
| 3,554,402 | 1/1971 | Lock | 206/193 |
| 3,747,801 | 7/1973 | Graser | 229/52 BC X |
| 3,977,518 | 8/1976 | Arneson | 229/52 BC X |
| 4,240,546 | 12/1980 | Stone | 229/52 BC X |

*Primary Examiner*—Steven M. Pollard

*Attorney, Agent, or Firm*—Alan Swabey; Robert Mitchell; Guy Houle

[57] ABSTRACT

A compact carton for beer bottles and the like is formed from a unitary blank and incorporates a dividing partition having a carrying handle formed therewith disposed centrally, vertically below the top of the carton; a display opening is defined in the top of the carton permitting a pleasing display of the carton contents and access to the handle. The filled cartons can be readily stacked one on top of the other for storage and transport and the contents can be readily removed by the customer through the display opening without breaking the carton apart. The carton has the additional advantage that it can be end-loaded.

13 Claims, 8 Drawing Figures

DISPLAY CARTON AND BLANK THEREFOR

BACKGROUND OF THE INVENTION

1. Field of the Invention

The invention relates to display cartons and a blank therefor; more especially the invention is concerned with an end-loading carton having a display opening to permit display of the contents, and a blank therefor. The invention is more particularly concerned with such cartons for carrying beverage containers including bottles and cans and having an integral carrying handle, and which can be readily stacked in use, one on top of the other.

2. Description of the Prior Art

Cartons are widely used for the shipment, storage and sale of containerized beverages, such as beer. One type of carton is top loaded and includes a sealed top for shipment. A disadvantage of top loading is that the machinery handling the containers, such as bottles, requires both a sideways and a downward movement.

End loading has become popular because the containers can be pushed into the carton from the side in one movement, as the carton passes along a conveyor.

It is usual to provide a handle or other means whereby such a carton can be carried; it is also usual particularly in cartons intended for bottles to include a central vertically disposed partition in the carton.

End-loading cartons with these basic desirable features are described in Canadian Pat. Nos. 884,165; 911,389; 920,531 and 971,137. Prior end-loading cartons such as those of the aforementioned patents suffer the disadvantage that the contents of the carton is fully enclosed so that the contents cannot be displayed to promote the sale thereof. Further such cartons either have handles which project outwardly from the top of the carton thereby rendering it impossible to efficiently stack the cartons, or a complicated retractable handle is employed.

In Canadian Pat. No. 884,165 the handle and partition are formed separately from the carton walls thus requiring two separate blanks, and the handle is retractable. In Canadian Pat. No. 911,389 the partition is formed separately from the carton and is set up between the bottles prior to loading and then moved into the casing along with the bottles.

Cartons, particularly cartons for bottled beer which permit display of the contents are known, these cartons are generally known in the trade as basket carriers. Such cartons permit the display of attractively presented products which are found to appeal to the consumer, for example, bottles of beer in which the bottle necks are attractively decorated, for example, with gold foil and neck labels to enhance the appearance.

European beer products displayed in this manner have proved to be highly successful in the North American market.

The combination of an attractive design on the carton walls and the display of attractively decorated bottles is found to be highly important in promoting North American beers in competition with such European imports.

SUMMARY OF THE INVENTION

It is an object of the present invention to provide a carton particularly for containerized beverages such as bottled beer, which has a display opening whereby the contents can be viewed so as to present a pleasing display to promote sale of the product.

It is a further object of the invention to provide such a display carton, which is an end-loading carton.

It is a further object of the invention to provide such a carton of compact structure having an integral permanently located handle to facilitate carrying of the carton, which handle does not project outwardly of the carton but is contained entirely within the carton, whereby the filled cartons can be readily stacked one on top of the other for storage or transport.

It is yet another object of the invention to provide a carton, particularly for bottled beverages such as beer, which when filled can be sealed at its ends, whereafter the product is accessible to the customer, through a display opening, without breaking the seals thereby avoiding damage to the carton and permitting its ready use for return of empty bottles.

It is yet another object of the invention to provide such cartons which can be formed from a unitary blank.

It is a still further object of the invention to provide unitary blanks for constructing such end-loading cartons.

In one aspect of the invention there is provided an end-loading carton comprising an open-ended tubular casing having a pair of side walls, a bottom wall and a pair of spaced apart top wall members defining a display opening therebetween, closure flaps connected to opposite ends of said bottom and side walls, a closure flap connected to an outer end of each top wall member, said closure flaps being folded over to form end walls closing the casing ends, a central vertical partition secured in said carton extending from said bottom wall to the underside of said top wall members, said partition having a slot therein to define a carrying handle below said top wall member with an upper portion of said partition.

In another aspect of the invention there is provided a stackable end loading carton having a display opening for display of the contents, a central vertical partition and a handle, said carton having a pair of spaced apart top wall members disposed in substantially the same plane, said partition being secured to said carton with an upper edge disposed so as not to project above said top wall members, and said handle being formed in an upper portion of said partition below said top wall members.

In yet another aspect of the invention there is provided a one-piece blank of foldable sheet material for constructing an end-loading carton having a dividing partition, a handle and a display opening, said blank being cut and scored to provide a top forming panel, first and second side panels integrally connected with said top forming panels, a bottom forming flap integrally connected to said first side panel, a bottom forming panel integrally connected to said second side panel, and to a partition panel and end closure flaps connected to opposite sides of said side panels, top forming panel, bottom forming panel and bottom forming flap to form end walls for closing the ends of the carton, said top forming panel being cut to define a pair of spaced apart top wall members and a handle element, said handle element being detachably secured to at least one of said side panels, at least a first slot defined in said handle element and a second slot defined in said partition panel adapted to lie adjacent said first slot on construction of said carton to define a hand grip part.

BRIEF DESCRIPTION OF THE DRAWINGS

The invention is illustrated in particular and preferred embodiments by reference to the accompanying drawings in which.

DESCRIPTION OF THE PREFERRED EMBODIMENTS

Figure 1:
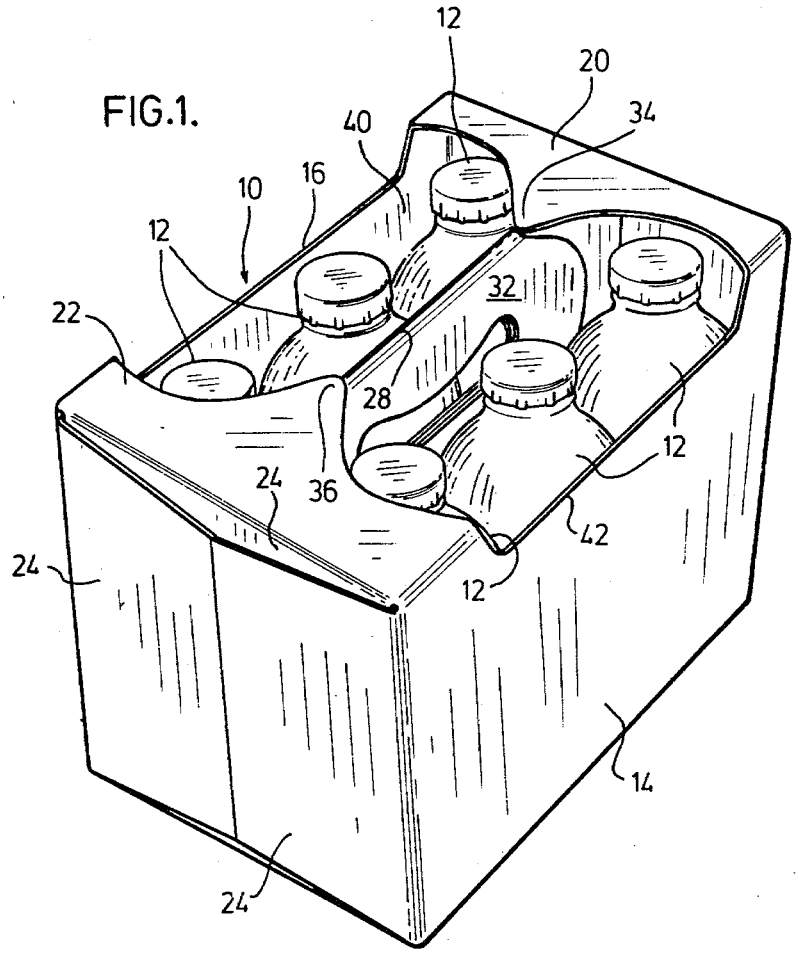
FIG. 1 is a perspective view of an assembled end-loaded carton of the invention containing bottled beer.

With further reference to FIG. 1 there is shown an assembled end-loaded carton 10 of the six-pack variety, containing six beer bottles 12.

Figure 2:
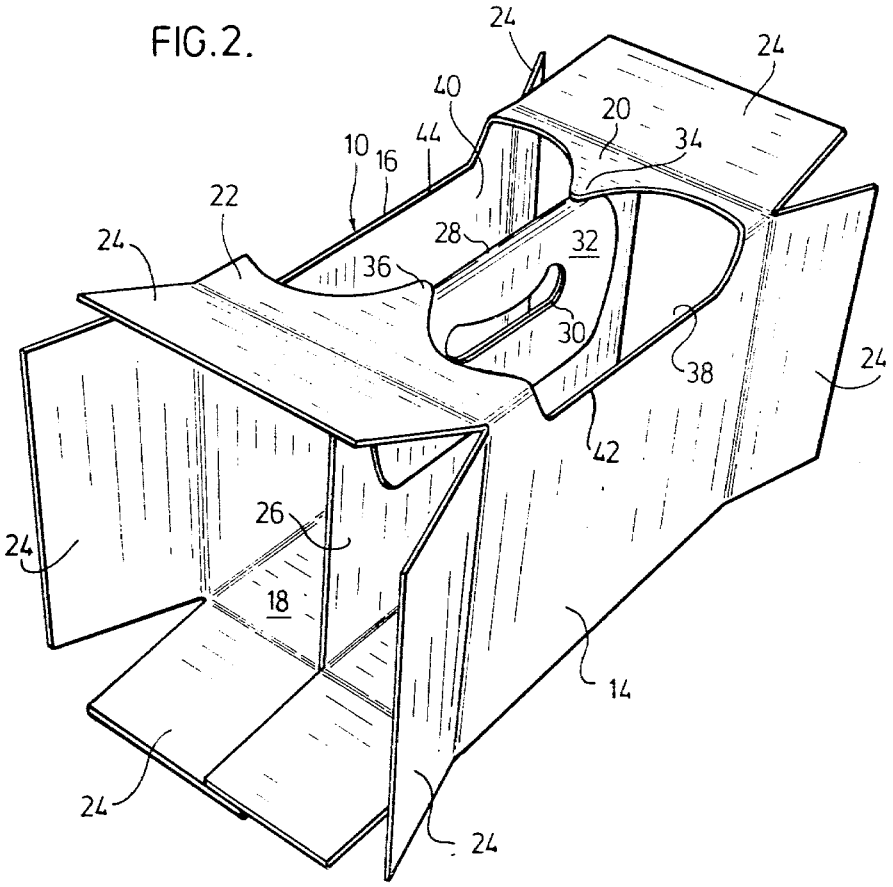
FIG. 2 is a perspective view of the partially assembled end-loading carton of FIG. 1.

With further reference to FIG. 2 there is shown a perspective view of the end-loaded carton 10 of FIG. 1 in a partially assembled stage prior to end-loading of the carton 10.

With further reference to FIGS. 1 and 2, the carton 10 has side walls 14 and 16, a bottom wall 18 and a pair of spaced apart top wall members 20 and 22.

Four end closure flaps 24 extend from each open end of the carton 10 (as shown in FIG. 2).

A partition 26 is centrally disposed in carton 10 extending between the bottom wall 18 and the top wall members 20 and 22.

A handle 32 having a slot 30 is formed in an upper portion of partition 26.

The top wall members 20 and 22 comprise top wall projections 34 and 36 respectively and a handle upper edge 28 extends between the projections 34 and 36.

A display opening 38 is defined between handle upper edge 28 and an upper edge 42 of side wall 14. A similar display opening 40 is defined between handle upper edge 28 and an upper edge 44 of side wall 16.

The top wall members 20 and 22 lie generally in the same plane. The handle upper edge 28 lies generally in the same plane as top wall members 20 and 22 so that top wall members 20 and 22 and handle upper edge 28 of carton 10 provide a generally flat supporting surface for a similar carton 10 to be stacked thereon.

The side walls 14 and 16 can be employed for decorative and advertising material, the display openings 38 and 40 permitting display of the upper ends of beer bottles 12 to facilitate an attractive presentation and display of the product as an aid to promotion.

The carton 10 can be readily carried by gripping the handle 32 by insertion of fingers through the slot 30.

Figure 3:
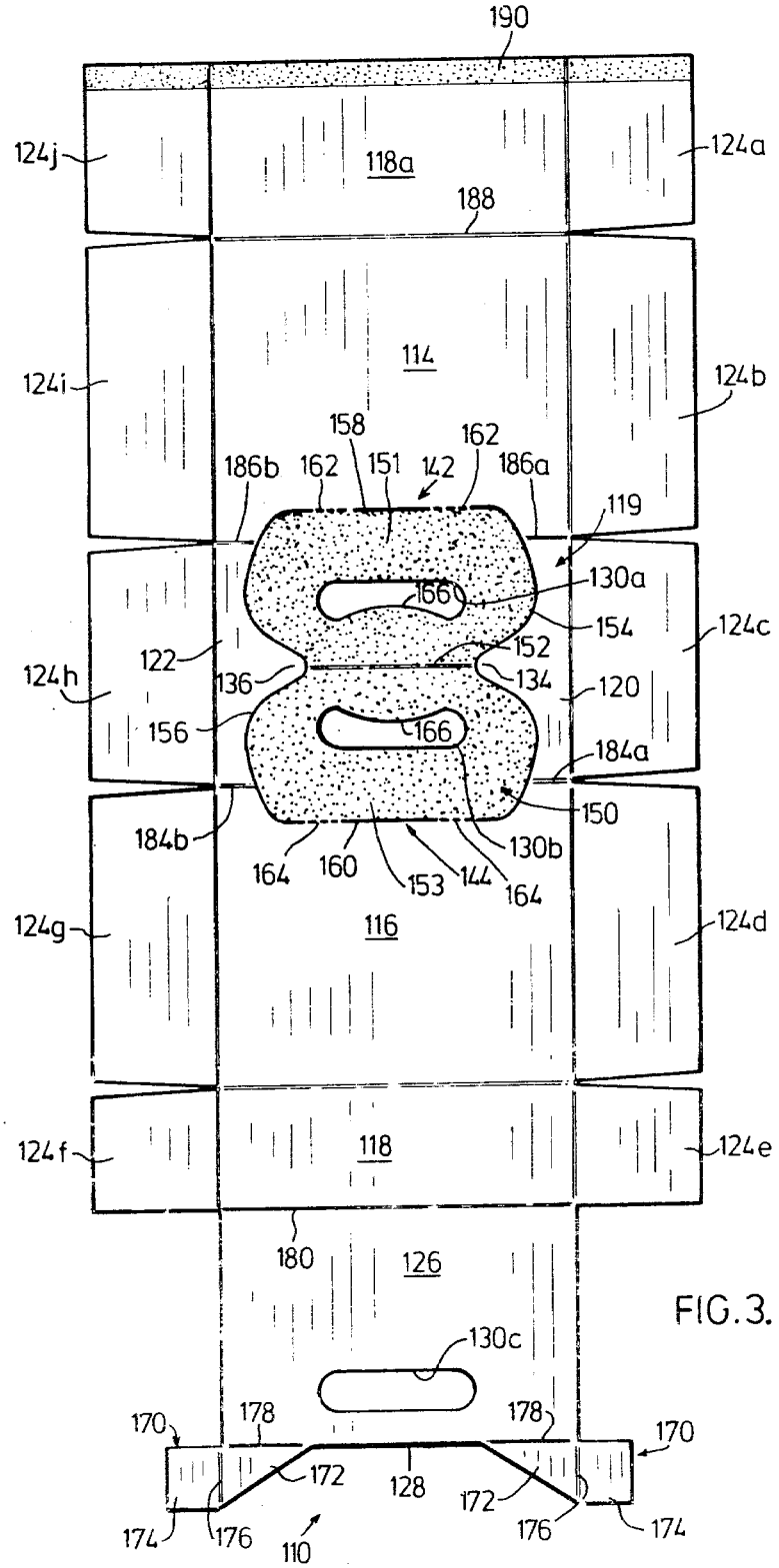
FIG. 3 shows a plan view of a blank for forming a first embodiment of the invention.
Figure 4:
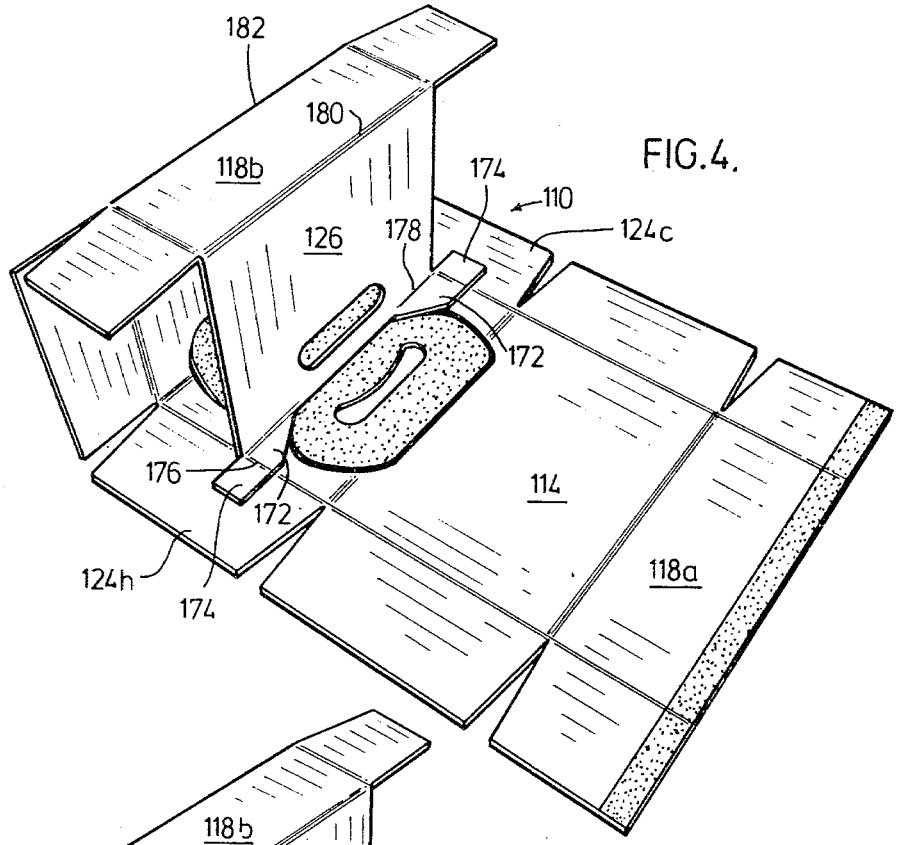
FIG. 4 shows the blank of FIG. 3, after the first assembly operation to locate the partition.
Figure 5:
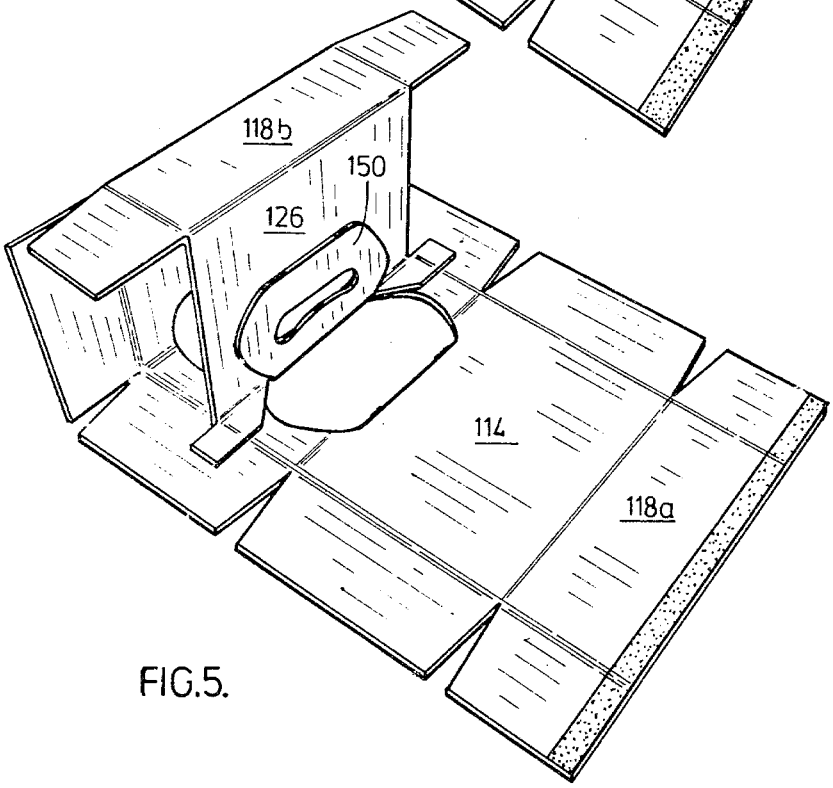
FIG. 5 shows the blank of FIG. 3 after the second assembly operation to locate a reinforcing panel on the partition to define a handle.
Figure 6:
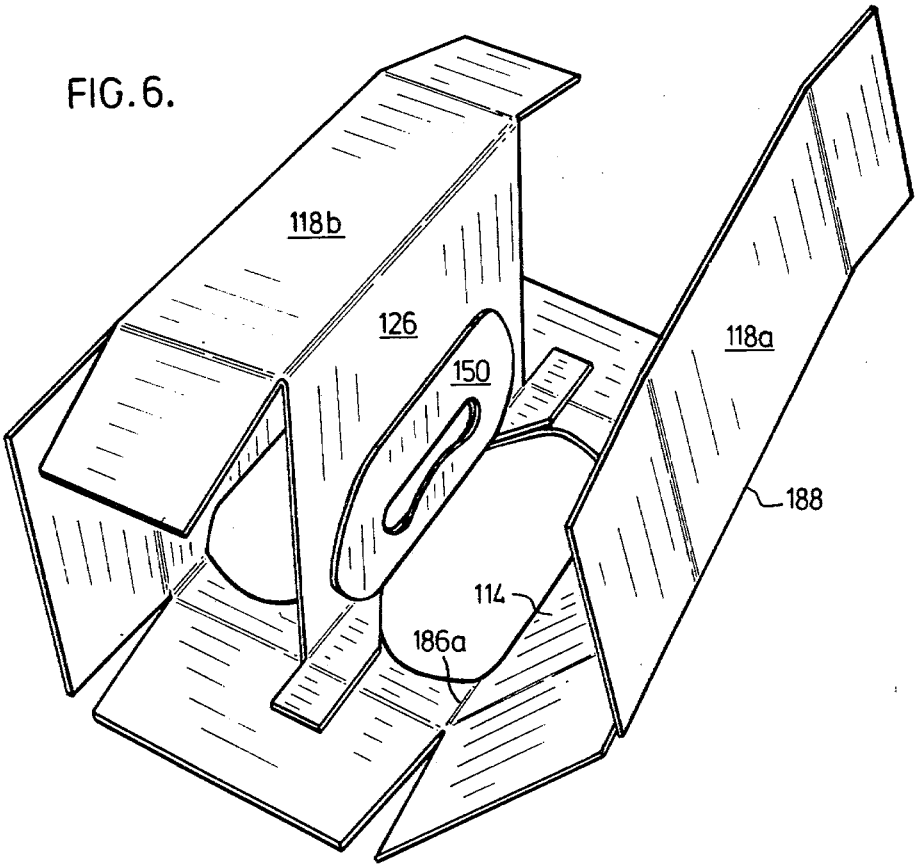
FIG. 6 shows the blank of FIG. 3 after the third and during the fourth assembly operation.

A blank 110 suitable for forming the carton 10 of FIGS. 1 and 2 is shown in FIG. 3. FIGS. 4, 5 and 6 show the blank 110 in successive folded positions in its assembly.

In FIGS. 3, 4, 5 and 6 the parts of the blank 110 corresponding to parts of the carton 10 in FIGS. 1 and 2 have corresponding numbers increased by 100. The shaded areas of blank 110 are areas to which adhesive is suitably applied for assembly of the carton, of course, the adhesive could, alternatively be applied to areas which the shaded areas are to contact.

With reference to FIG. 3 a blank 110 comprises side walls 114 and 116, a bottom forming flap **118*a*, a bottom forming panel 118*b*, a top forming panel 119 and a partition panel 126**.

End closure flaps **124*a*, 124*b*, 124*c*, 124*d*, 124*e*, 124*f*, 124*g*, 124*h*, 124*i* and 124*j* are connected to panels 114, 116, 118*b* and 119 and flap 118*a***.

Top forming panel 119 comprises top wall members 120 and 122 and a handle element 150 (shown in shaded lines).

Top wall members 120 and 122 include top wall projections 134 and 136 respectively.

The handle element 150 is defined by opposed cut lines 154 and 156 and opposed cut lines 158 and 160.

A pair of spaced apart partially severed or perforated lines 162 is disposed one on either side of cut line 158; the perforated lines 162 separate cut line 158 from cut lines 154 and 156. A similar pair of partially severed or perforated lines 164 is disposed one on either side of cut line 160 and separates cut line 160 from cut lines 154 and 156.

Cut line 158, perforated lines 162 and adjacent portions of cut lines 154 and 156 define an edge 142 of panel 114 which forms upper edge 42 of the carton 10 in FIG. 1. Similarly cutline 160, perforated lines 164 and portions of cut lines 154 and 156 define an edge 144 of panel 116 which forms upper edge 44 of side wall 16 in the carton 10 of FIG. 1.

The handle element 150 includes a central crease 152, which is partially cut through on its reverse side (not shown), and handle sides 151 and 153.

Slots **130*a* and 130*b* are defined in handle element 150, and a slot 130*c* is defined in partition panel 126. Projections 166 extend from crease or score lines 168 into slots 130*a* and 130*b***.

Partition panel 126 includes a partition upper edge 128 and a pair of tabs 170. The tabs 170 are hingedly connected to partition panel 126 along score or crease lines 178.

Each tab 170 includes a tab portion 172 and a tab portion 174 hingedly connected to tab portion 172 along a score or crease line 176.

Partition panel 126 and bottom forming panel **118*b* are connected along a score or crease line 180, and panel 118*b* and side panel 116 are connected along a score or crease 182**.

A pair of score or crease lines **184*a* and 184*b* connect side panel 116 and top wall members 120 and 122** respectively.

Score or crease lines **186*a* and 186*b* connect top wall members 120 and 122 and side panel 114**.

A score or crease line 188 connects side panel 114 and bottom forming flap **118*a***.

Flap **118*a* has a zone 190 (shaded) for adhesion to bottom forming panel 118*b* to form bottom wall 18 of the carton 10 in FIG. 1**.

With further reference to FIGS. 4, 5 and 6, there are shown different stages in the assembly of the blank 110 of FIG. 3 to form the carton of FIGS. 1 and 2.

With reference to FIG. 4, the blank 110 is folded along score lines 180 and 182 and tabs 170 are folded along score lines 178 so that tab portions 174 overlie end closure flaps **124*c* and 124*h* to which they are to be adhered and tab portions 172 overlie top wall projections 134 and 136** to which they are to be adhered.

FIG. 5 shows a further state of the assembly operation in which the handle element 150 has been separated from panels 114 and 116 along edges 142 and 144 respectively by tearing perforated lines 162 and 164.

The handle element 150 is folded about score line 152 so that handle sides 151 and 153 lie on either side of partition panel 126 to which they are to be adhesively secured with slots 130*a* and 130*b* lying over slot 130*c* in partition panel 126, to form a double reinforcement for handle 32 of carton 10.

With reference to FIG. 6 side panel 114 is folded about score lines 186*a* and 186*b* and bottom forming flap 118*a* is folded about score line 188 to overlap bottom forming panel 118*b* and is secured thereto at adhesive zone 190.

The thus formed open ended carton 10 as shown in FIG. 2 is end loaded in conventional manner, whereafter the closure flaps are closed in conventional manner.

It will be noted that flaps 124*a* and 124*e*, and 124*f* and 124*j* together form the bottom closure flaps of the carton 10.

Figure 7:
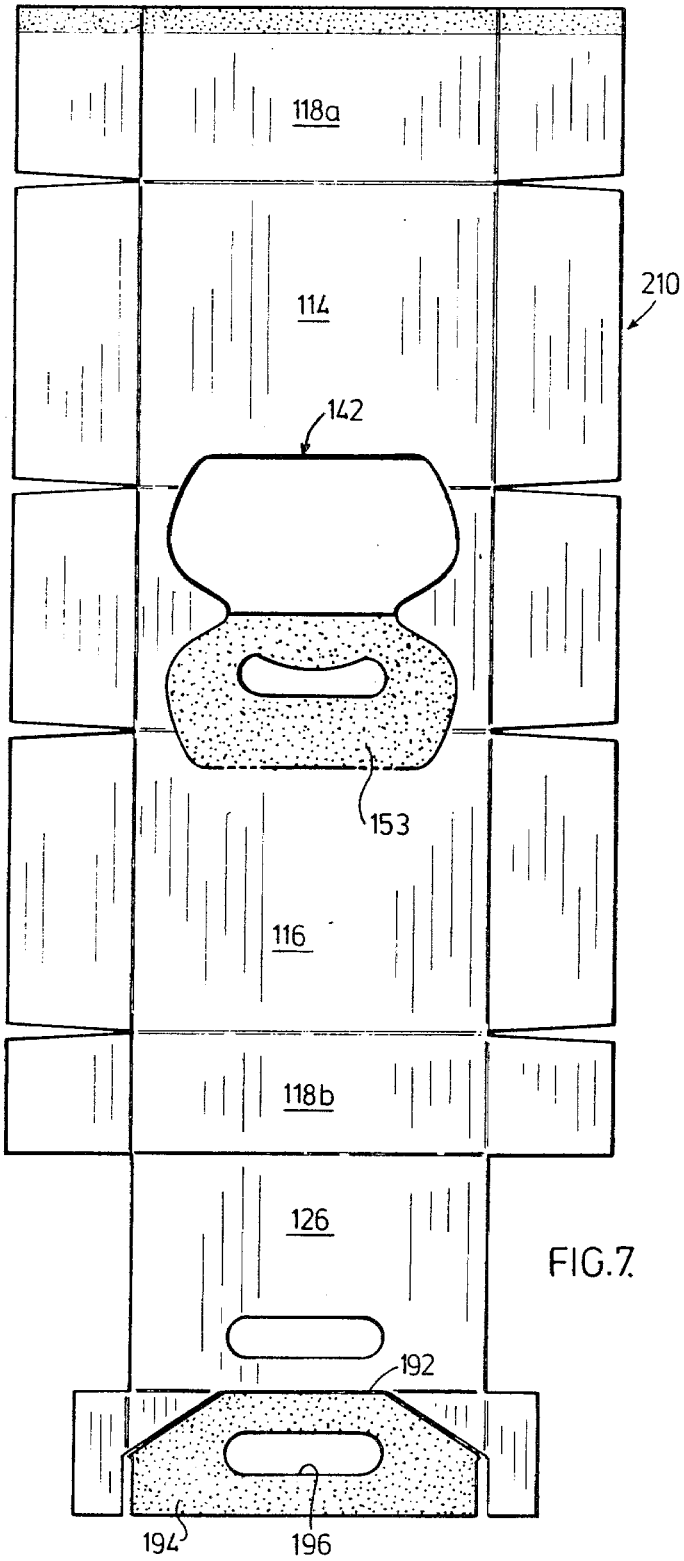
FIG. 7 is a plan view of a blank for forming a second embodiment of the invention.

With further reference to FIG. 7 there is shown a blank 210 similar to that of FIG. 3. Parts in blank 210 which are identical to parts in FIG. 3 have been numbered as for blank 110 in FIG. 3.

In blank 210 handle side 151 of the handle element 150 in FIG. 3 has been removed by cutting along score line 152 to leave solely handle side 153.

A reinforcing element 194 having a slot 196 is connected to partition panel 126 along a score or crease line 192.

The blank 210 is assembled in a manner similar to that of blank 110, with reinforcing element 194 folded along crease 192 and located between handle side 153 and partition panel 126, so that a double reinforcement in handle 32 of carton 10 is obtained.

Figure 8:
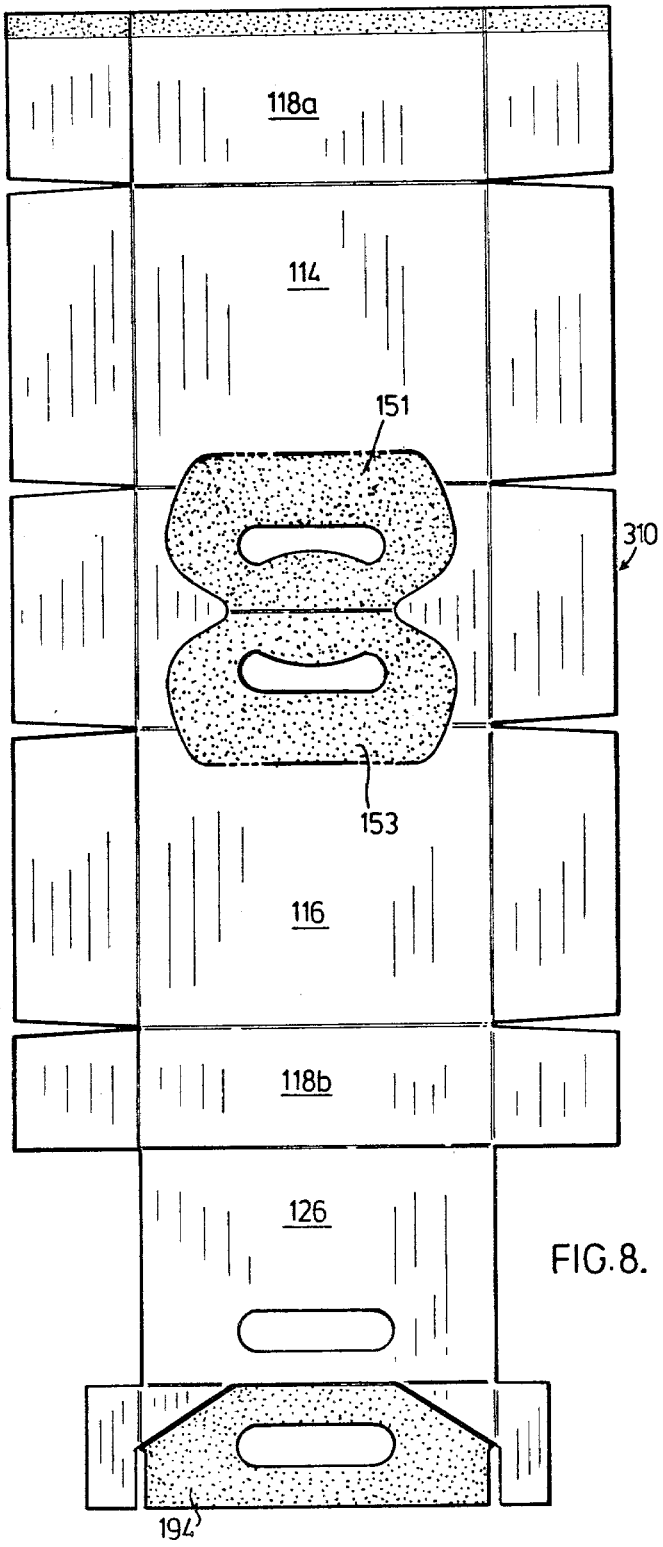
FIG. 8 is a plan view of a blank for forming a third embodiment of the invention.

FIG. 8 shows a blank 310 containing the features of the blank 110 of FIG. 3 and the reinforcing element 194 of FIG. 7.

Blank 310 is assembled in a manner similar to blanks 110 and 210 with reinforcing element 192 disposed between partition panel 126 and handle side 153.

When carrying the end-loaded carton 10 of FIG. 1, the fingers of the hand are inserted into the slot 30 of handle 32, and projections in slot 30, corresponding to 166 in FIG. 3 are pressed to one side along score lines 168, the thus formed downwardly facing projection 166 forming a comfortable finger contacting zone.

It will be recognized that blanks 210 and 310 employ addition material in providing reinforcing element 194 and in view of this blank 110 is preferred, particularly when the carton 10 is to house a relatively small number of articles such as six bottles.

On the other hand, the additional amount of material becomes less significant economically with increase of the carton size to hold a greater number of articles such as bottles, and when a greater number of bottles is to be housed, blank 310 of FIG. 8 may be preferred if a stronger handle 32 is required.

The carton 10 is suitably formed from a foldable sheet material, particularly paperboard, however, other sheet materials having the necessary qualities of stiffness and foldability can be employed.

Reference has been made to "side wall" or "side panel," as well as "top" and "bottom" in referring to panels and walls. It is to be understood that this is for the purpose of identifying the various parts.

In this specification reference to a "score line" identifies an indentation, crease, partial severing or similar formation or alteration in the blank, introduced to facilitate folding of the blank in assembling the carton.

The reinforced handle formed in the carton of the invention in the embodiment illustrated in FIG. 3, and particularly in the embodiment illustrated in FIG. 8, employing reinforcing element 194 makes it possible to use stock of lighter caliper for example 20 to 25 point stock and more typically 22 to 25 point stock.

I claim:

1. An end loading carton comprising an open-ended tubular casing having a pair of side walls, a bottom wall, and a pair of spaced apart top wall members defining a display opening therebetween, end wall closure flaps connected to opposite ends of said bottom and side walls, an end wall closure flap connected to an outer end of each top wall member, said end wall closure flaps being folded over to form end walls closing the casing ends, with said top wall members extending towards each other from said casing ends, a central vertical partition secured in said carton extending from said bottom wall to the underside of said top wall members, said partition having a slot therein to define a carrying handle below said top wall members with an upper portion of said partition, said partition extending between said casing ends and said bottom wall being formed by a bottom forming flap hingedly connected along a fold line to a first of said side walls and a bottom forming panel hingedly connected along a fold line to a second of said side walls, said bottom forming panel being hingedly connected along a fold line to said partition.

2. A carton according to claim 1, wherein a pair of display openings are defined separated by said partition and said openings extend into an upper portion of each side wall.

3. A carton according to claim 2, wherein the carrying handle is reinforced by at least one reinforcing panel having a slot defined therein to match with the partition slot, said reinforcing panel mating with the adjacent display opening when said carton is flattened about a first fold between the bottom wall and the side wall of said adjacent opening and a second fold between the other side wall and said top wall members.

4. A carton according to claim 3, including a pair of said reinforcing panels hingedly connected along an upper edge of the partition between the top wall members and secured to opposite sides of said partition.

5. A carton according to claim 3, including a reinforcing element for said carrying handle, hingedly connected about a third fold line along an upper edge of said partition between the top wall members, a slot defined in said reinforcing element to match with the partition slot and at least one reinforcing panel slot, said reinforcing element, partition and at least one reinforcing panel being secured together to form said carrying handle.

6. A carton according to claim 4, including a reinforcing element for said carrying handle, hingedly connected about a third fold line along an upper edge of said partition between the top wall members, a slot defined in said element to match with the partition slot and reinforcing panel slots, said reinforcing element, partition and reinforcing panels being secured together to form said carrying handle.

7. A carton according to claim 1, wherein said partition is secured in said carton by a pair of tabs hingedly connected to an upper edge of said partition.

8. An end loading carton comprising an open ended tubular casing having a pair of side walls, a bottom wall and a pair of spaced apart top wall members, defining a display opening therebetween, end wall closure flaps connected to opposite ends of said bottom and side walls, an end wall closure flap connected to an outer end of each top wall member, said end wall closure flaps being folded over to form end walls closing the casing ends, with said top wall members extending towards each other from the casing ends, a central vertical partition extending from said bottom wall to the underside of said top wall members and between the casing ends, a pair of display openings separated by said partition, a slot defined in an upper portion of said partition to define a carrying handle below said top wall members, a pair of reinforcing panels for said carrying handle having slots defined therein to match the partition slot, said bottom wall being formed by a bottom forming flap hingedly connected along a first fold line to a first of said side walls and a bottom forming panel hingedly connected along a second fold line to a second of said side walls, said bottom forming panel being hingedly connected along a sixth fold line to said partition; said bottom forming flap and bottom forming panel being overlappingly secured together; said partition being secured in said carton by at least one tab on an upper edge of said partition; said top wall members and the partition upper edge being disposed in substantially the same plane.

9. A one-piece blank of foldable sheet material for constructing an end-loading carton having a dividing partition, a handle and a display opening, said blank being cut and scored to provide a top forming panel, first and second side panels integrally connected with said top forming panel, a bottom forming flap integrally connected to said first side panel, a bottom forming panel integrally connected to said second side panel and to a partition panel, and end closure flaps connected to opposite sides of said side panels, top forming panel, bottom forming panel and bottom forming flap to form end walls for closing the ends of the carton, said top forming panel being cut to define a pair of spaced apart top wall members, said top wall members extending towards each other from the end closure flaps of the top forming panel, and a handle element, said handle element being detachably secured to at least one of said side panels, at least a first slot defined in said handle element and a second slot defined in said partition panel adapted to lie against said first slot on construction of said carton to define a hand grip part.

10. A blank according to claim 9, wherein said partition panel includes a pair of spaced apart tabs for securing said partition to said top wall members on construction of said carton.

11. A blank according to claim 10, wherein said handle element is detachably secured to said first and second side panels and has a pair of first slots defined therein adapted to lie on either side of said second slot on construction of said carton to define said hand grip.

12. A blank according to claim 10, which further includes a handle reinforcing element integrally connected to said partition panel and a third slot in said reinforcing element adapted to define said hand grip with said first and second slots on construction of said carton.

13. A blank according to claim 11, further including a handle reinforcing element integrally connected to said partition panel and a third slot in said reinforcing element adapted to define said hand grip with said second slot and said pair of first slots.

* * * * *